US005382328A

United States Patent [19]

Drespa et al.

[11] Patent Number: 5,382,328

[45] Date of Patent: Jan. 17, 1995

[54] INSTALLATION FOR PROCESSING WASTE OIL

[76] Inventors: Gerd Drespa, Brunebeckweg 59, Dortmund 50, D-4600; Heinz-Günter Rittscher, Hackertsbergweg 98, Witten-Rüdinghausen D-5810, both of Germany

[21] Appl. No.: 852,124

[22] PCT Filed: Nov. 1, 1989

[86] PCT No.: PCT/DE89/00695

§ 371 Date: Jun. 12, 1992

§ 102(e) Date: Jun. 12, 1992

[87] PCT Pub. No.: WO91/06805

PCT Pub. Date: May 16, 1991

[51] Int. Cl.[6] ..... B01D 3/00; F23G 7/05

[52] U.S. Cl. ..... 202/235; 202/241; 196/98; 196/120; 208/179; 208/184; 208/186

[58] Field of Search ..... 196/98, 120; 202/235, 202/241; 208/179, 184, 186

[56] References Cited

U.S. PATENT DOCUMENTS

| | | | |
|---|---|---|---|
| 4,342,645 | 8/1982 | Fletcher et al. | 208/184 |
| 4,512,878 | 4/1985 | Reid et al. | 208/184 |
| 4,666,587 | 5/1987 | Martin | 208/184 |

FOREIGN PATENT DOCUMENTS

| | | |
|---|---|---|
| 2619883 | 11/1976 | Germany . |
| 3023374 | 1/1982 | Germany . |
| 3642041 | 6/1988 | Germany . |
| 3814146 | 11/1989 | Germany . |
| 244839 | 6/1947 | Switzerland . |
| 460656 | 9/1968 | Switzerland . |
| 1215422 | 12/1970 | United Kingdom | 208/186 |

*Primary Examiner*—Helen M. S. Sneed
*Assistant Examiner*—Walter D. Griffin
*Attorney, Agent, or Firm*—James Creighton Wray

[57] ABSTRACT

For the processing of waste oil, i.e. environmentally safe processing, a process and installation are used whereby the waste oil is preheated with the distillation gases and is then distilled itself by burning the distilled waste oil. The liquid and solid residues are exposed to the flame produced by the combustion of the distilled waste oil, while the gaseous residues are heated to over 1,200° C. in a long-hold chamber constructed as a fume incinerator. In order to calcine the solid or burn the liquid residues, they are collected in the distillation chamber and transported via a rotating cylinder and a chute into the combustion chamber where they are then correspondingly calcined by the burner flame. In contrast, the gaseous residues are fed to a long-hold chamber, whereby the latter is a pipe system with a length of 75 m or more. Heating rods or heating wires are inserted into the individual pipes of the pipes system, so that the waste gases are brought specifically and continuously to the required temperature and are then cooled again. The flue gases cooled in this way and freed from noxious substances may then be released into the atmosphere. By using this process and the waste oil processing installation, it is possible to effectively process even waste oils heavily contaminated with noxious substances and to either destroy the inevitable residues in an environmentally safe way or to process them in such a way that they may be disposed of in an environmentally safe manner.

8 Claims, 4 Drawing Sheets

INSTALLATION FOR PROCESSING WASTE OIL

BACKGROUND OF THE INVENTION

The invention relates to a waste oil processing installation, comprising a combustion chamber surrounded by the distillation chamber with cleaning and transport worm and rotating cylinder extending into the combustion chamber and a cooled condensation chamber as well as a cleaning section for the waste gases. The invention relates also to a process for operating the installation.

Distillation processes are used for separating various substances. During continuous distillation, a prewarmed mixture of several substances enters a column at a level determined by the separation task, whereupon the lower boiling fraction is withdrawn on the top as distillate, the intermediate products in side columns, and finally the heavy fraction on the bottom as a residue. In the case of crude oil, the distillates are e.g. heated in a long pipe to final distillation temperature prior to entering the column in order to save energy and to avoid a separation of carbon and hydrocarbons caused by overheating in the column. But it is difficult to distill so-called waste oil, because the latter has absorbed various noxious substances, such as metals and plastics, during its use. During a normal distillation process, such noxious substances cannot be separated with sufficient safety. In contrast, waste oils containing little or no noxious substances are collected and then processed again centrally by normal distillation. But contaminated waste oils must be stored at great expense and disposed of in a different way. Known from German OLS 31 49 025 is a heating process and from German OLS 36 42 041 is a waste oil processing process where such waste oils containing more or less contaminations are distilled in a small installation and then reused e.g. to operate the heating plant. But such an installation of DE OS 36 42 041 no longer can be used in cases where the above-mentioned waste oils containing noxious substances shall or must be processed or used. Using the waste oil processing installation known from the principal claim or by using the corresponding process, the noxious substances may be isolated or destroyed in solid or gaseous form by bringing them either before the burner flame and thus calcining them, or by heating them to a temperature above 1,200° C. so that the present noxious substances are destroyed. The disadvantage of the known process and device is that because of the contamination of the waste oil its processing in the distillation chamber automatically causes the heavier waste oil to settle and especially with noxious substances to deposit at the distillation chamber wall so that significant problems occur. The known cleaning section for destroying gaseous noxious substances also requires significant expenditure. For this reason, the gaseous noxious substances in particular are also frequently withdrawn in part.

The invention therefore has the task of making the waste oil processing installation and the corresponding process unsusceptible to failure and to ensure that all noxious substances are destroyed in the system itself.

SUMMARY OF THE INVENTION

In order to operate the installation and thus reduce the environmental burden, the invention provides that together with the solid residues the waste vapors from the oil processing and storage are collected and continuously brought before the burner flame. In particular, this prevents annoying odors and also makes it possible to use these waste vapors in a way which promotes the process.

The invention provides that the waste gases are mixed with oxygen or the water steam and/or the lower boiling fractions separated during a pretreatment of the waste oil and then brought together before the burner flame in order to improve the destruction of the water steam and other noxious substances. This advantageously raises the flame temperature so that a destruction of the noxious substances contained in the water steam or the lower boiling fractions is ensured, especially if an additional, suitable emulsifier is used.

Solid components in the waste oil prevent its further processing, especially distillation. Because of this, the process provides that the waste oil is filtered or centrifuged prior to its distillation, so that these heavy parts are removed at an early time. Depending on the composition and type, it is then possible to also bring these parts before the burner flame, to calcine them and thus to prepare them for disposal.

According to the invention the task is solved by having the cleaning and transport worm reach up to the wall of the distillation chamber and equipping it with hard metal teeth which have small lead angles. This ensures that the sticky to resinous waste oil parts deposited on the wall are safely scraped from the latter and transported away before deposits form which make the further operation of the installation impossible. Since the deposits on the wall inhibit a transition of the temperature from the combustion chamber to the distillation chamber during distillation, this ensures that the entire distillation process proceeds quickly and safely. The components scraped off and detached by the hard metal teeth or blades are then transported further via the cleaning and transport worm and are then fed via the rotating cylinder into the combustion chamber where they are destroyed. The detached material is transported safely over the boiler floor, since according to the invention the lead angle of the hard metal teeth is small. In this way they seemingly scrape off the material deposited on the boiler floor or wall and simultaneously transport it in the direction of the rotating cylinder.

In order to ensure that the waste oil in the distillation chamber is somewhat mixed and homogenized by the cleaning and transport worm, but is not permanently mixed through with the scraped off parts, it is provided that the cleaning and transport worm has on its outside a bridge carrying the hard metal teeth and has openings in the center. This results in a sufficient resting position for the waste oil in the distillation chamber and thus an overall homogeneous distillation.

The scraped off material which is fed to the rotating cylinder is safely fed to the flame, since it is provided, according to another useful variation, that the rotating cylinder is constructed as a rotary pocket valve and is equipped with a chute which reaches up to the flame. The material which is viscous but is now subject to a higher temperature in the combustion chamber is at this time conveyed in the direction of the flame via this chute and is calcined by the high temperature and prepared for disposal. Because of the safe calcining, the residual material may then be safely disposed in general landfills without a danger that noxious substances which may possibly still be contained in it are washed out by rain.

In order to balance the processing, the invention provides that several condensation chambers are correlated with the distillation chamber. It is also possible that the condensation chamber is constructed in several sections, so that in the end even different distillates may be removed, depending on what the processed waste oil will be used for.

According to the invention, a simple, but completely effective processing and destruction of the waste gases is ensured by constructing the cleaning section as a fume incinerator in which pipes with integrated heater together form a meander-shaped pipe system. Depending both on the heating speed and the necessity of subjecting the waste gases to a suitable high temperature for a long time, this makes it possible to create a pipe system with a length of 75 m and more in order to ensure in this way that all noxious substances carried in the fumes are thoroughly burned and thus made harmless. The gas is passed back and forth through the pipe coils within the fume incinerator so that an appropriate skilled control ensures that the flue gases are first prewarmed, then heated to a high temperature, and are then cooled down again before they are released into the atmosphere through the exhaust chimney. This ensures an accurate control of the waste gases, but also enables the necessary insulation of the pipe system which is respectively integrated into the fume incinerator. The high temperature areas are hereby in the center of the furnace, i.e. the other areas in a way secure and insulate them, so that such a furnace is very economical.

The pipes are usefully constructed in two parts which fit inside each other, both to be able to facilitate installation of the pipes inside the fume incinerator and also to equip these pipes according to need with heaters or not, so that a continuous heating and cooling down of the waste gases is achieved.

It has already been pointed out above that it is useful to first heat the exhaust gases, to feed them into a high temperature zone subsequently, and to then cool them down prior to releasing them into the atmosphere. This is achieved especially advantageously, if the heater consists of heating rods extending into the pipes, whereby the number of pipes with heating rods increases up to approximately the center of the fume incinerator and from there on decreases again. This ensures continuous heating of the exhaust gas without causing an excessive negative effect on economy.

The invention is especially characterized in that an installation is created which enables the processing or reprocessing of even heavily contaminated waste oil without hampering the process or installation by frequent failures. In addition, the noxious substances carried in the waste oil are in fact retained and destroyed, i.e. are not released back into the environment. The useful process permits environmentally safe operation of the installation.

Other details and advantages of the invented object are derived from the following description of the related drawing in which a preferred embodiment is shown with the necessary details and individual parts.

DETAILED DESCRIPTION OF THE DRAWINGS

Figure 1:
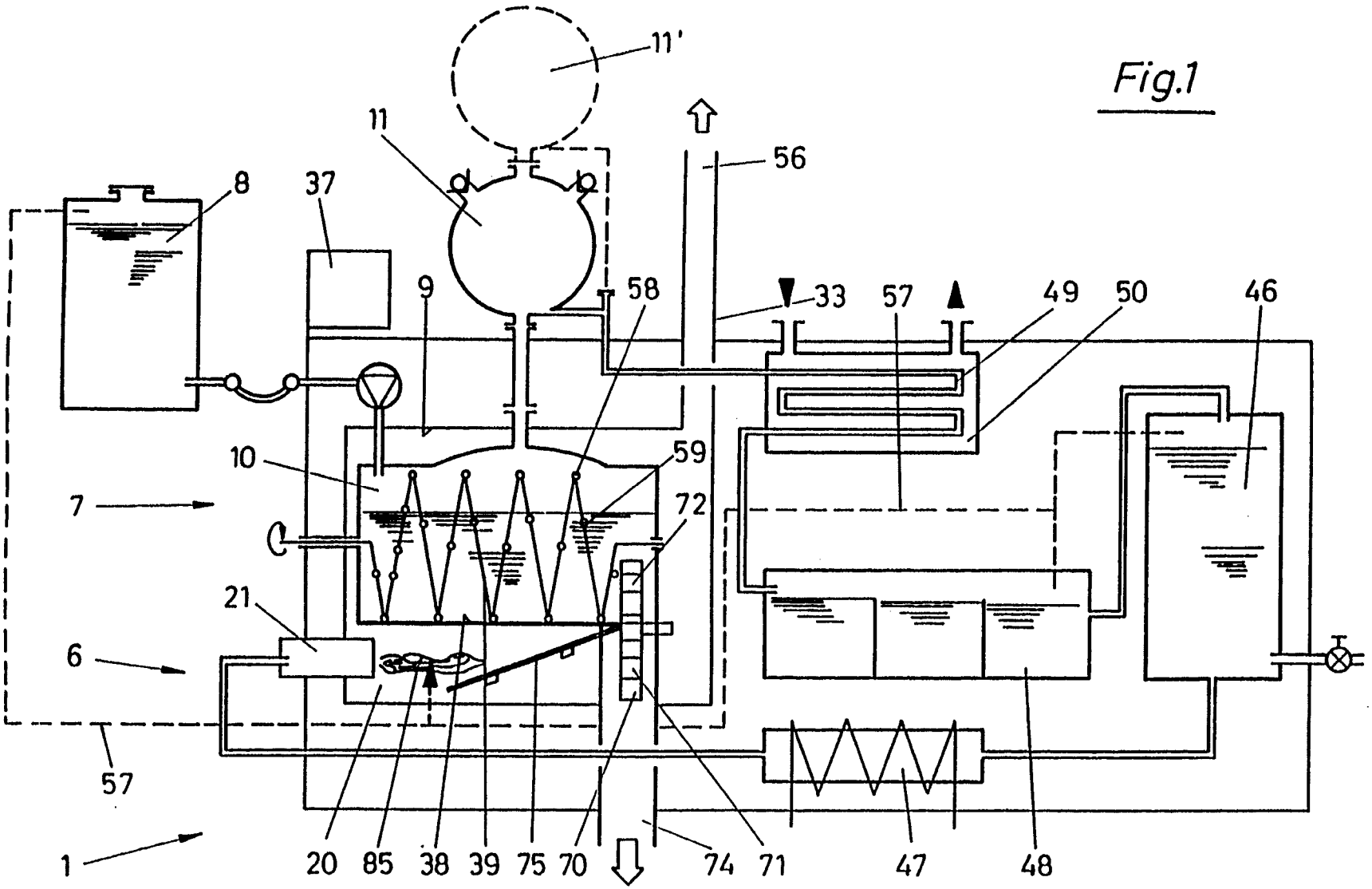
FIG. 1 shows a schematic portrayal of the waste oil processing installation.

The central point of the waste oil processing installation (1) shown in FIG. 1 is the kettle-shaped part which serves simultaneously as distillation tower. The latter is connected via a number of pipes which carry the thermal medium, i.e. in this case water, to various radiators which are e.g. distributed inside a house so that the waste oil processing installation is able to simultaneously support a heater or similar area.

The actual boiler consists of a combusting part (6) and a distillation part (7), each of which are connected via pipe systems with the waste oil tank (8) through which the waste oil is pumped into the distillation part (7).

The schematic drawing according to FIG. 1 indicates that the distillation part (7) again consists of two areas, i.e. the distillation chamber (10) with its preferably curved walls (9), whereby the liquid medium is distilled, i.e. vaporized, in this distillation chamber and is then precipitated in the condensation chamber (11), i.e. returned from the gaseous to the liquid phase. The two chambers are connected to each other via an internal pipe, or the distillation chamber (10) turns into the internal pipe which again projects far into the condensation chamber (11).

The condensation chamber (11) is surrounded by a bell, the external mantle of which is totally or partially washed and surrounded by water. In this way, the oil is quickly and safely condensed, whereby it precipitates at the inside of the bell, runs to the bottom collection groove, and may then be pumped off. For increased safety, the top part of the bell is connected to the atmosphere via a safety valve. The pipe connected to the safety valve is passed through the cooling unit.

The cooling unit is supplied by the forward flow with cooled water and returns the heated water e.g. into a heating installation via the return flow.

The combustion chamber (20) into which a burner (21) projects is constructed like an opening in the distillation chamber (10). Several pipes in which the waste oil is specifically exposed indirectly to the hot flame run along the back wall of the opening. The remaining combustion chamber (20) is surrounded by the oil, i.e. the waste oil intended for the distillation, so that the heat originating from the burner flame is advantageously transferred. The waste gases safely pass through the intermediate spaces between the pipes into the waste gas pipe or exhaust chimney (56). The oil level inside the distillation chamber (10) is kept even by a pressure compensation pipe whose top end projects into the inside pipe and whose bottom end ends in the distillation chamber (10). The top piece of the pressure compensation pipe runs parallel to the wall of the inside pipe. The pressure compensation pipe extends to the outside wall of the heating boiler or is passed out of the heating boiler and is, after passing an exterior viewing window with controller, returned to the distillation chamber.

In the floor or at the floor (38) of the distillation chamber, (10) a cleaning and transport worm (39) with a perforated end piece is installed. The cleaning worm, like the other parts, is controlled via central electronics (37). The cleaning and transport worm is equipped on the outside with hard metal teeth (58, 59) which ensure that material deposited on the wall (9) is safely removed and is then transported via the worm (39) itself to the rotating cylinder (70). This sticky and solid material is then passed through the rotating cylinder (70) with pockets (72, 71) via a chute (75) close to the flame (85) where it is calcined.

The flame (85) is also fed with the exhaust gases produced in the waste oil tank (8) and the storage container (46) and preheating tank (47) as in the three-chamber filter system (48) so that they also are destroyed at the same time while advantageously promoting the combustion itself. Solid material which possibly may still be present then is brought by a scraper or similar transport device (not shown here) through the combustion chamber (20) to the discharge pipe (74) from where it is brought in containers or similar devices to the landfill.

Figure 2:
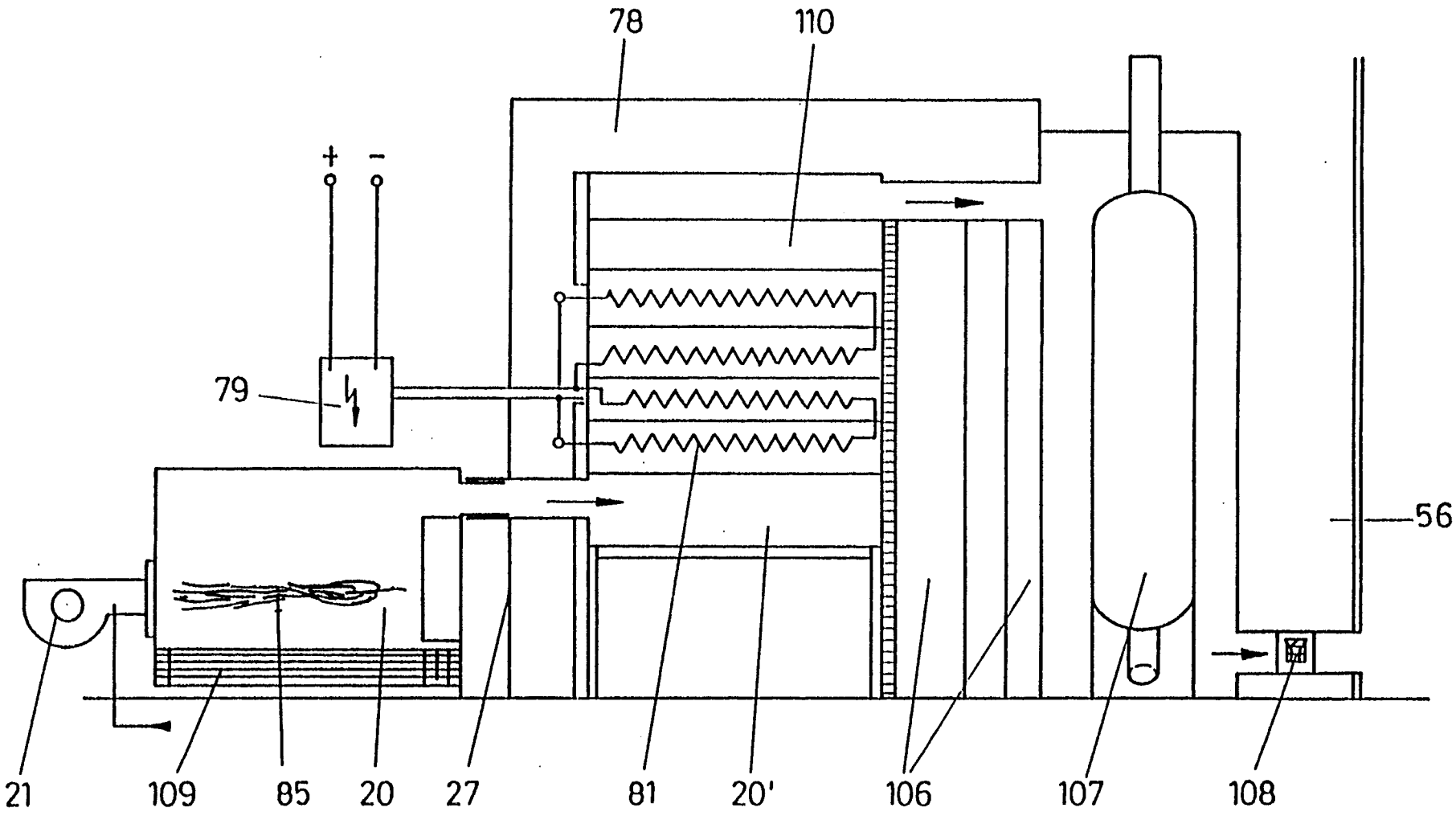
FIG. 2 shows the waste oil processing installation with cleaning section.

This so-called air-water combustion (27) is again shown in FIG. 2, where it is indicated where and how the waste gases and also the water steam parts withdrawn from predistillation are effectively and easily destroyed. The waste gas still remaining after this is released via the exhaust pipe (33) and the exhaust chimney (56) into the atmospheric environment. The exhaust pipe through which the mentioned waste gases are also brought into the area of the flame (85) is designated with the number (57).

According to FIG. 1, the condensation chamber (11) is located above the distillation chamber (10). (11) is another condensation chamber through which any fractions with different boiling ranges may be withdrawn. The cleaned oil obtained in this way is then passed via a pipe into the area of the pressurized cooler (50) with its coil (49), whereupon it is fed to the three-chamber filter system (48) and finally to the storage container (46).

While FIG. 1 shows the destruction of the noxious substances obtained in the liquid area of the waste oil processing installation (1), it is not further shown what should be done with the gaseous waste gases. In this context, FIG. 2 explains that these waste gases are, prior to reaching the exhaust chimney (56), first passed through a cleaning section (78) with switching unit (79). FIG. 2 does not show details regarding the construction of this cleaning section (78). These details are shown in the remaining drawings. The cleaning section (78) in the form of a fume chamber is equipped both with a heater (81) and an insulation (106) in order to keep the necessary high temperature for the effect of the long hold on the waste gases. The hot waste gases which are again partially cooled down already in the cleaning section (78) are then passed through a heat exchanger (107) and are transported by the blower (108) into the exhaust chimney (56) from where they are released into the atmosphere.

We already reported on the air-water combustion (27) which is used to bring water steam and other gaseous products before the flame (85). FIG. 1 also shows that solid components are additionally calcined before the flame (85). The residues obtained in this process are removed via the transport grate (109) into the discharge pipe (74).

Figure 3:
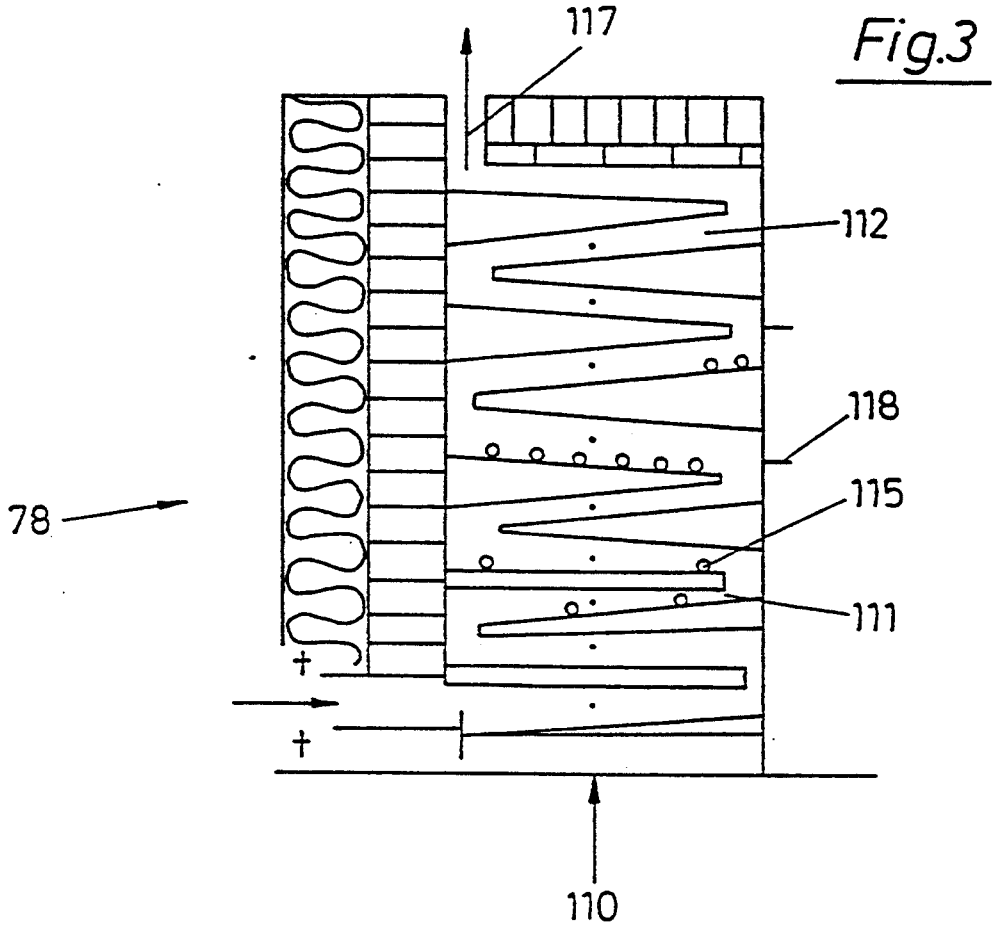
FIG. 3 shows a cross-section of the cleaning section which is constructed as a fume incinerator.

The cleaning section (78) consists of a pipe system (110), the details of which are shown or suggested in FIG. 3 and the following figures. The individual pipes (11,112) end in each other and ensure that the waste gas is brought gradually to a certain temperature and is then cooled again. For this purpose, individual pipes (111), or in the center area all pipes, have heating rods (115) or heating wires (116) which confer the appropriate temperature to the waste gases as they flow by. The waste gas is added via the input opening and is removed again through the area of the waste gas channel (117). The term waste gas channel (117) here is used for the hollow spaces formed in the pipes (111, 112), as shown in the remaining figures. It is also conceivable to form in the center of the cleaning section (78) which is constructed as a fume incinerator an open chamber (118) in which a number of heating rods (115) may then be arranged in such a way that the waste gases in fact do have their highest temperature here or are heated to the appropriate high temperature. The temperature then decreases again in the direction of the exit, while the number of heating rods (115) is reduced.

Figure 4:
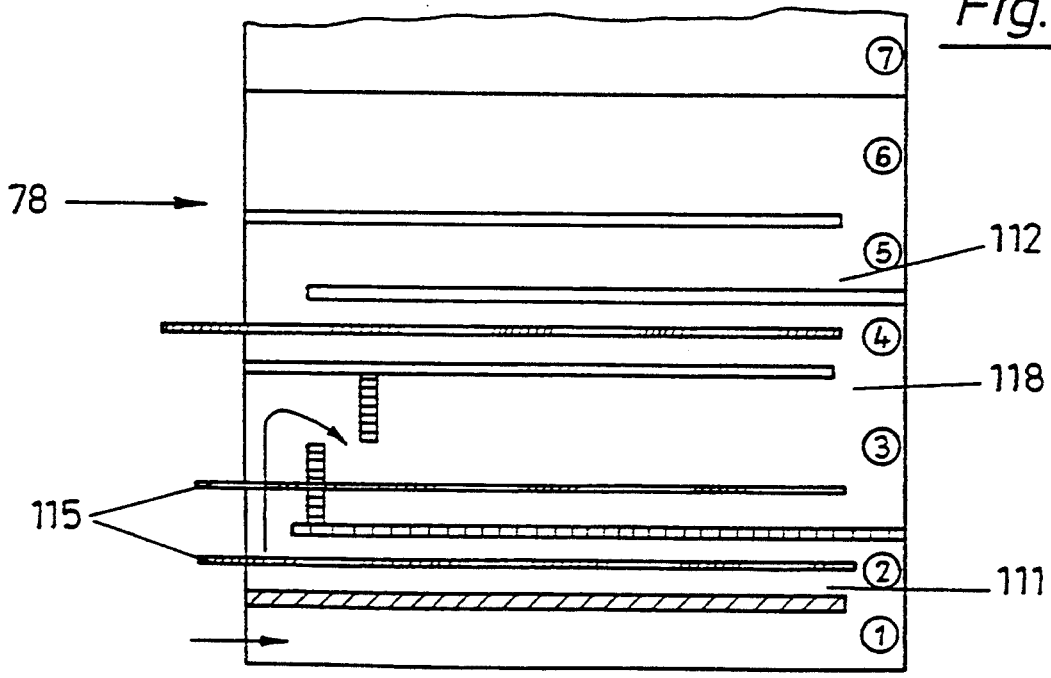
FIG. 4 shows a longitudinal section of the cleaning section according to FIG. 3.

While FIG. 3 shows a cross-section of the cleaning section (78), FIG. 4 shows a longitudinal section.

Figure 5:
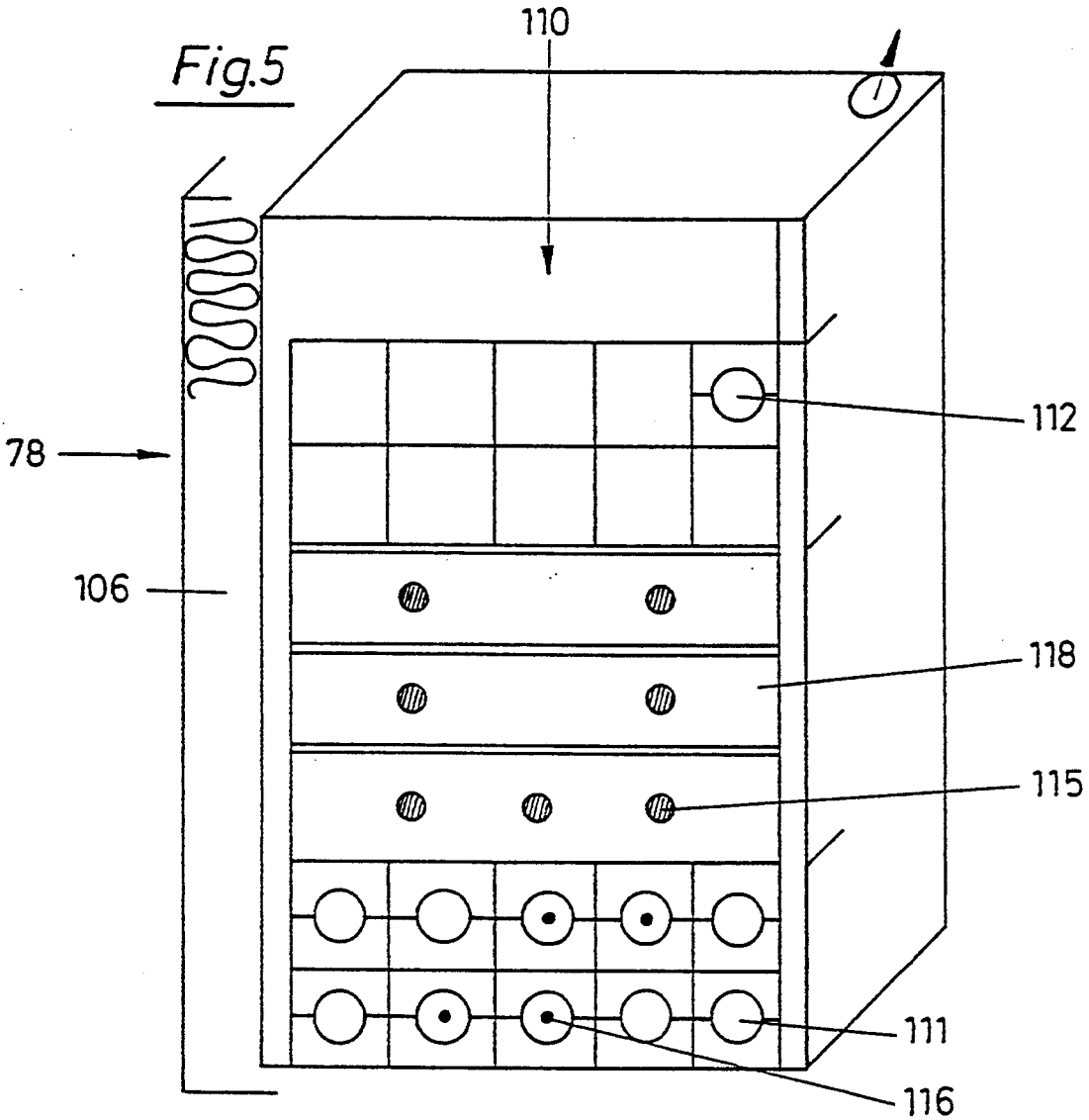
FIG. 5 shows a frontal projection of the cleaning section.
Figure 6:
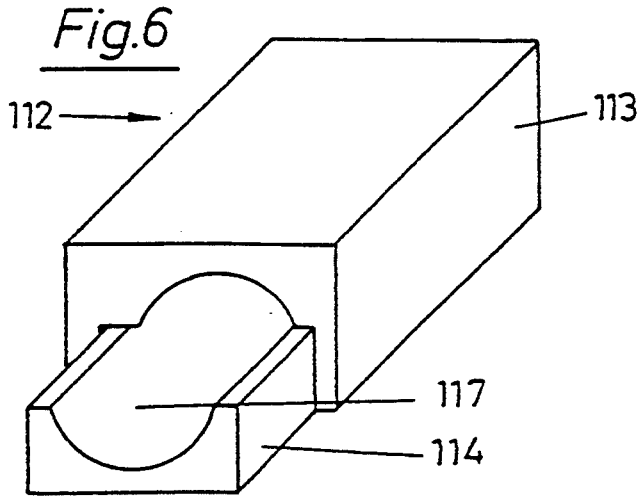
FIG. 6 shows a perspective projection of a two-part pipe.
Figure 7:
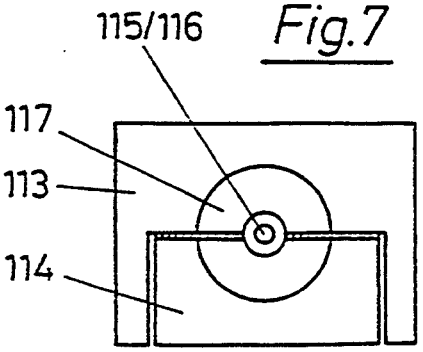
FIG. 7 shows a section of the pipe.

FIG. 5 finally also provides only an enlarged or overall view of the cleaning section (78), whereby heating wires (116) are installed in the bottom part, and heating rods (115) in the center of the pipes (111, 112). FIG. 6 and 7 show how they are installed. The individual pipes (111, 112) each consist of a top part (113) and a bottom part (114), whereby the heating rods (115) or heating wires (116) are clamped with their support parts between the two parts (113, 114).

We claim:

1. A waste oil processing installation comprising a distillation chamber surrounded by a combustion chamber, a cooled condensation chamber, and a waste gas cleaning section, said distillation chamber containing a cleaning and transport worm equipped with hard metal teeth and extending to the wall of the distillation chamber and a rotating cylinder with pockets, said rotating cylinder extending into the combustion chamber.

2. The installation according to claim 1, characterized in that the cleaning and transport worm (39) has a bridge carrying the hard metal teeth (58, 59) on the outside and openings in the center.

3. The installation according to claim 1, characterized in that the rotating cylinder (70) is constructed as a rotary pocket valve and is equipped with a chute (75) which extends up to a flame (85).

4. The installation according to claim 1, characterized in that plural condensation chambers (11) are connected to the distillation chamber (10).

5. The installation according to claim 1, characterized in that the condensation chamber (11) is constructed as plural sections.

6. The installation according to claim 1, characterized in that the cleaning section (78) is constructed as a fume incinerator in which pipes (111, 112) with integrated heaters (81) form a meander-shaped pipes system (110) with each other.

7. The installation according to claim 6, characterized in that the pipes (111, 112) are constructed in two parts and fit inside each other.

8. The installation according to claim 7, characterized in that a heater (81) is formed by heating rods (115) which extend into the pipes (111, 112), whereby the number of pipes with a heating rod reaches a maximum up to approximately the center of the fume incinerator (78) and decreases in the number of pipes from there.

* * * * *